United States Patent [19]

Morey

[11] 4,175,409

[45] Nov. 27, 1979

[54] CLOTHES WASHING MACHINE

[75] Inventor: Everett D. Morey, Louisville, Ky.

[73] Assignee: General Electric Company, Louisville, Ky.

[21] Appl. No.: 848,536

[22] Filed: Nov. 4, 1977

Related U.S. Application Data

[63] Continuation-in-part of Ser. No. 695,585, Jun. 14, 1976, abandoned.

[51] Int. Cl.[2] ..... D06F 37/00

[52] U.S. Cl. ..... 68/4; 68/27

[58] Field of Search ..... 68/4; 12R, 27

[56] References Cited

U.S. PATENT DOCUMENTS

| | | | |
|---|---|---|---|
| 2,225,407 | 12/1940 | Bassett | 68/12 R |
| 2,651,190 | 9/1953 | Horvath | 68/12 R |
| 2,743,599 | 5/1956 | Bilde et al. | 68/21 |
| 3,014,358 | 12/1961 | Bochan | 68/4 |
| 3,324,688 | 6/1967 | Hubbard | 68/4 |
| 3,521,470 | 7/1970 | Bochan | 68/12 R X |
| 3,575,020 | 4/1971 | Hubbard | 68/4 |
| 3,672,189 | 6/1972 | High et al. | 68/12 R |

*Primary Examiner*—Philip R. Coe

*Attorney, Agent, or Firm*—Bruce A. Yungman; Radford M. Reams

[57] ABSTRACT

An improved vertical axis clothes washing machine and method having wash, rinse, and spin extraction operations including a tub, an agitator, a first basket within the tub, a second basket disposed within the first basket and positioned on the agitator for movement therewith. There is also a water supply for feeding hot and cold water into the machine, electrically powered drive for operating the agitator to effect washing of the fabrics and for rotating the baskets to centrifugally extract water from the fabrics. Water is allowed to flow from the baskets into the tub and may be recirculated from the tub into the baskets during the wash and rinse operations. The improvement is a separate cycle of a continuous wash and rinse operation followed by a spin extraction operation for washing clothes in only the second basket while fresh water is introduced continuously into the second basket during the combined wash and rinse operation and directed to drain and not recirculated. At the end of the continuous wash and rinse operation the fresh water flow is stopped and a centrifugal extraction operation is completed. The improved machine and method minimizes the amount of water used, reduces the temperature of the water and clothes to minimize wrinkling during the spin operation, improves the removal of oily soil responsive to detergent concentration, and provides for the removal of "removed" soil from the basket which minimizes redeposition.

8 Claims, 3 Drawing Figures

CLOTHES WASHING MACHINE

CROSS REFERENCE TO RELATED APPLICATION

This application is a continuation-in-part of application Ser. No. 695,585, filed June 14, 1976, and now abandoned.

BACKGROUND OF THE INVENTION

This invention relates to automatic clothes washing machines and more particularly to an improved structure in such machines for effecting the washing of very small loads of clothing and especially delicate and synthetic fiber types of clothing.

Automatic clothes washing machines customarily provide, in a clothes basket adapted to hold several pounds of clothes, a sequence of operations in order to wash, rinse, and extract water from the clothes in the basket. The sequence ordinarily includes a water fill followed by a washing operation which, in a vertical axis type machine, is provided by an agitator movably arranged to oscillate back and forth within the basket; a first centrifugal liquid extraction operation in which the wash water is removed from the clothes by spinning the basket; another water fill followed by a rinsing operation in which the clothes in the basket are rinsed in clean water while the agitator is oscillated; and a final centrifugal liquid extraction operation in which the basket is spun to remove the rinse water from the clothes. Machines having this type of cycle, or a variation thereof, generally produce highly satisfactory results in that the clothes in the machine come out properly cleaned and with a substantialy part of the liquid removed.

As stated, in order to have an adequate capacity, the clothes containing basket must be large enough to accept several pounds of clothing generally in the range of eight to twelve pounds, and to contain them loosely enough so that a satisfactory washing effect will be obtained. Because of this prime factor, that of adequate clothes capacity, the clothes containing basket presents some disadvantages when a very small load of clothes is to be washed. This type of load may occur for various reasons, but in particular, it occurs with respect to delicate and dainty garments which are usually made from synthetic fibers or blends of synthetic and cotton fibers. These type garments should be washed by themselves and not with other heavier garments, and particularly with respect to clothes which are not colorfast, such as socks, jeans, etc. which would harm other clothing if washed with them.

One disadvantage which presents itself when very small loads are washed in the basket of a washing machine is that the amount of water required for washing a few small garments may be comparable to the amount of water used for washing several pounds of clothing. This, of course, represents an inefficient use of water with a resulting high cost of water and energy in heating the water in consideration of the result being obtained. Also, there is the corollary that the greater the quantity of water used, the greater quantity of detergent needed in order to effect a proper detergent concentration in the water, and this too represents an increased cost factor. Considerations such as these have quite often led the owners of domestic clothes washing machines to do the washing of small quantities of delicate garments by hand despite the availability of the machine.

One solution to this problem is the use of a small basket placed on the agitator inside the larger regular wash clothes basket. The motion of the agitator carries with it the small basket and provides a motion of the liquid in the basket which causes a suitable delicate type washing action. This type of washing machine is described in U.S. Pat. No. 3,014,358 and is assigned to the assignee of the present invention. In the use of a small wash basket as described in U.S. Pat. No. 3,014,358, the clothes within the small basket are subjected to the same operational cycles as when the machine is used with a "normal" operation, that is, when the clothes are in the large basket and includes a water fill followed by a bath type washing operation. A bath type washing action is when the clothes are submerged in water that nearly fills the small wash basket. After the washing operation there is a first centrifugal liquid extraction operation in which the wash water is removed by spinning the basket. There is then another water fill followed by a rinsing operation wherein clean fresh water is introduced into the basket and agitated and then followed by a final centrifugal liquid extraction operation by spinning the basket again. The disadvantages in such a clothes washer and method of washing clothes is brought about particularly by the use of synthetic fibers in today's garments. There is a tendency during the spin or liquid extraction operation for the clothes to become compacted by the centrifugal force and wrinkling is induced. The wrinkling is more likely to occur when the water is warm and it has been found to be advantageous to gradually reduce the temperature of the water before the centrifugal liquid extraction operation. In addition, it is highly desirable to reduce the amount of water used in the washing and rinsing operations as compared to bath type operations, yet maintain the good washing characteristics of the machine and method.

By my invention I have improved the prior art washing machine. The amount of water used is reduced by utilizing a flow-through wash and rinse operation where the clothes are only sopping wet as compared to bath type operations which in turn results in less detergent being needed for the washing operation.

SUMMARY OF THE INVENTION

There is provided in a vertical axis clothes washing machine having wash, rinse, and spin extraction operations including a tub, an agitator, a first basket within the tub, a second basket disposed within the first basket and positioned on the agitator for movement therewith, water supply means feeding hot and cold water into the machine, electrically powered drive means for operating the agitator to effect washing of the fabrics and for rotating the baskets to centrifugally extract water from the fabrics, communication means to allow water to flow from the baskets into the tub, recirculating means arranged to take water from the tub and recirculate it into the baskets during the wash and rinse operations, an improved clothes washing machine and method. The improvement comprises incorporating into the clothes washing machine described above a separate cycle of a continuous wash and rinse operation followed by a spin extraction operation for washing clothes in only the second basket and includes means to continuously introduce fresh water into the second basket during the combined wash and rinse operation and diverting means in the recirculation means to continuously direct water to drain during the continuous wash and rinse operation. There is also provided means to stop the flow of fresh water into the second basket at the end of the combined wash and rinse operation after which a spin extraction operation follows and water is taken from the tub and directed to drain.

DESCRIPTION OF THE PREFERRED EMBODIMENT

Figure 1:
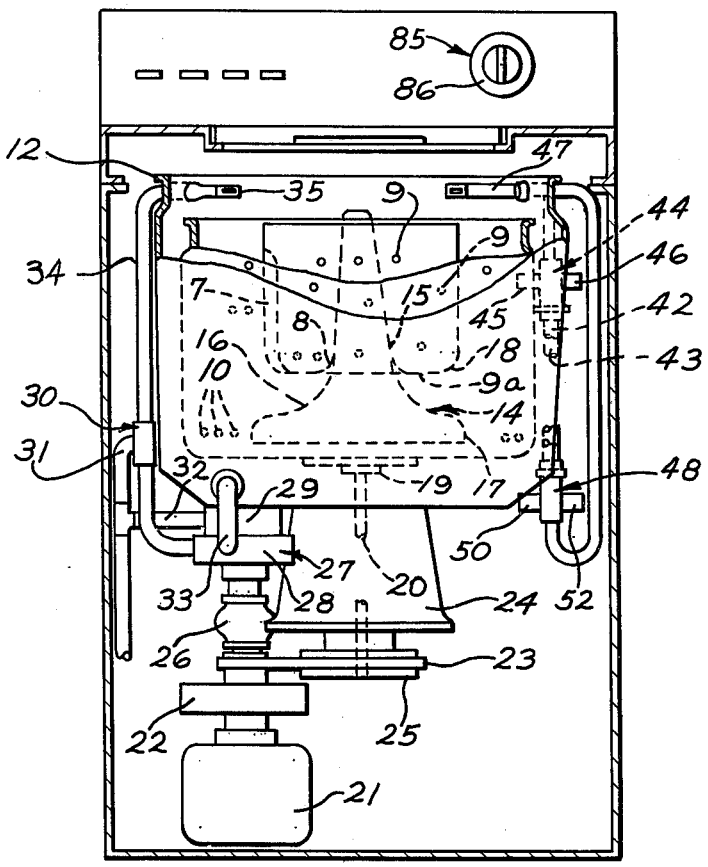
FIG. 1 is a schematic front elevational view of a clothes washing machine incorporating my invention, the view being partly broken away and partly in section.

Referring now to the drawing, and initially to FIG. 1 thereof, there is illustrated an agitator-type vertical-axis automatic clothes washer 10 having a supporting structure or load member 11. The washer may include the various operational components conventionally utilized in a domestic automatic washing machine, for instance, an imperforate tub 12 rigidly mounted within structure 11. Rotatably supported within tub 12 is a perforate washing basket 13 having openings 10 for washing and rinsing clothes therein and for centrifugally extracting liquid therefrom. At the center of basket 13 there is provided an agitator 14 which includes a center post 15 having a plurality of water or liquid circulating vanes 16 joined at their lower end to form an outwardly flared skirt 17.

Both the clothes basket 13 and the agitator 14 are rotatably mounted. The basket 13 is mounted on a hub 19 and the agitator 14 is mounted on a shaft 20 which extends upwardly through the hub 19 and through the center post 15 and is secured to the agitator so as to drive it. During one possible cycle of operation of the washer 10, fabrics, detergent and a predetermined quantity of liquid are introduced into the tub 12 and basket 13, and the agitator is then oscillated back and forth about its axis to move the clothes within the basket. After a predetermined period of this washing action, the agitator and basket 13 are rotated in unison at high speed to centrifugally extract the washing liquid from the fabrics and discharge it to a drain (not shown). Following this extraction operation, a supply of clean fresh liquid is introduced into the basket for rinsing the fabrics and the agitator is again oscillated. Finally, the agitator and basket are once more rotated in unison at high speed to extract the rinse liquid.

Also secured on the agitator 14 so as to move therewith is a clothes containing basket 18 which is small relative to basket 13 and tub 12. Basket 18 has a plurality of openings 9 in the side wall and particularly at the bottom and one or more conventional very small opening *9a* in the bottom wall for removal of heavy soil. The openings 9 are to provide for flowing water through the basket 18 so that the basket does not fill. Thus a flow through washing and rinsing action is provided and not a bath type washing and rinsing action. This aspect will be described in more detail later. The lower inner portion of the annular basket 18 may be formed as shown at 8 to accommodate the tops of the vanes 16 of the agitator and acts to position the basket securely on the top of the agitator so that there will not be any relative rotation of the two.

Completing the description of basket 18, it is preferably provided with suitable fins or vanes 7 on the inner surface of the outer wall, which vanes are formed so as to effect a washing movement of the clothes within the basket 18 in response to the movement of the basket which is provided to it by its association with the agitator 14.

The small basket 18 is preferably removably positioned on agitator 14 so that it may be removed when so desired and readily replaced on the agitator and secured thereto so as to move therewith.

The basket 13 and agitator 14 may be driven by any suitable means. By way of example, I have shown them as driven by a reversible motor 21 through a drive mechanism including a clutch 22 mounted on the motor shaft. The motor is tailored so as to be used to its full extent when it accelerates the basket 13 to spin speed. In order to assist the motor during starting, clutch 22 allows the motor to start with less than a full load and then accept the full load as it comes up to speed. A suitable belt 23 transmits power from clutch 22 to a transmission assembly 24 through a pulley 25. Thus, depending upon the direction of motor rotation, the pulley 25 of transmission 24 is driven in opposite directions. The transmission 24 is so arranged that it supports and drives both the agitator drive shaft 20 and the basket mounting hub 19. When motor 21 is rotated in one direction, the transmission causes agitator 14 to oscillate and when motor 21 is driven in the opposite direction, the transmission causes the clothes basket 13 and agitator 14 to rotate together at high speed for centrifugal fluid extraction.

In addition to operating the transmission 24 as described, motor 21 also provides a direct drive through flexible coupling 26 to a pump structure 27, which includes two separate pumping units 28 and 29 which are operated simultaneously in the same direction by motor 21. Pump unit 29 has an inlet connected to the tub 12 and an outlet connection by a conduit 32 to a suitable external drain (not shown). Pump 28 has an inlet connected by a conduit 33 to the interior of tub 12 and an outlet connected by conduit 34 to a nozzle 35 which is positioned to discharge into the basket 13. Located between the nozzle 35 and pump unit 28 is a liquid diverter assembly 30 for alternatively directing the liquid flow to conduit 31 that is connected to conduit 32 for discharge to an external drain. The purpose of the flow diverting arrangement will be discussed later. With this structure, then, the "normal operation" of the washer, that is, when clothes are washed in the large outer basket 13, when the motor 21 is operating so as to provide the washing mode or agitation, pump unit 28 draws liquid in from tub 12 and discharges it through conduit 34 into the basket 13. Conversely, when the motor is reversed so as to rotate the basket 13 and agitator 14 together at high speed to centrifugally extract fluid from fabrics in the basket, pump unit 29 will draw liquid from the tub and discharge it through conduit 32 to drain. Each of the pump units is substantially inoperative in the direction of rotation in which it is not used.

Hot and cold water may be applied to the machine through conduits 42 and 43 which are adapted to be connected respectively to sources of hot and cold water (not shown). Conduits 42 and 43 extend into a conventional mixing valve structure 44 having solenoids 45 and 46 and being connected to a nozzle 47. In a conventional manner selective or concurrent energization of solenoids 45 and 46 will provide passage of hot, cold or warm water from the mixing valve 44 through the nozzle 47. Nozzle 47 is positioned to discharge into the basket 18 so that when one or both of solenoids 45 and 46 are energized, water enters the machine.

Connected to the hot and cold water conduits 42 and 43 is another conventional mixing valve structure 48 having solenoids 50 and 52 and being connected to the nozzle 47. This mixing valve 48 is utilized, as will be discussed later, in connection with the improved washing cycle for delicate and synthetic garments being washed in the small basket 18.

Figure 2:
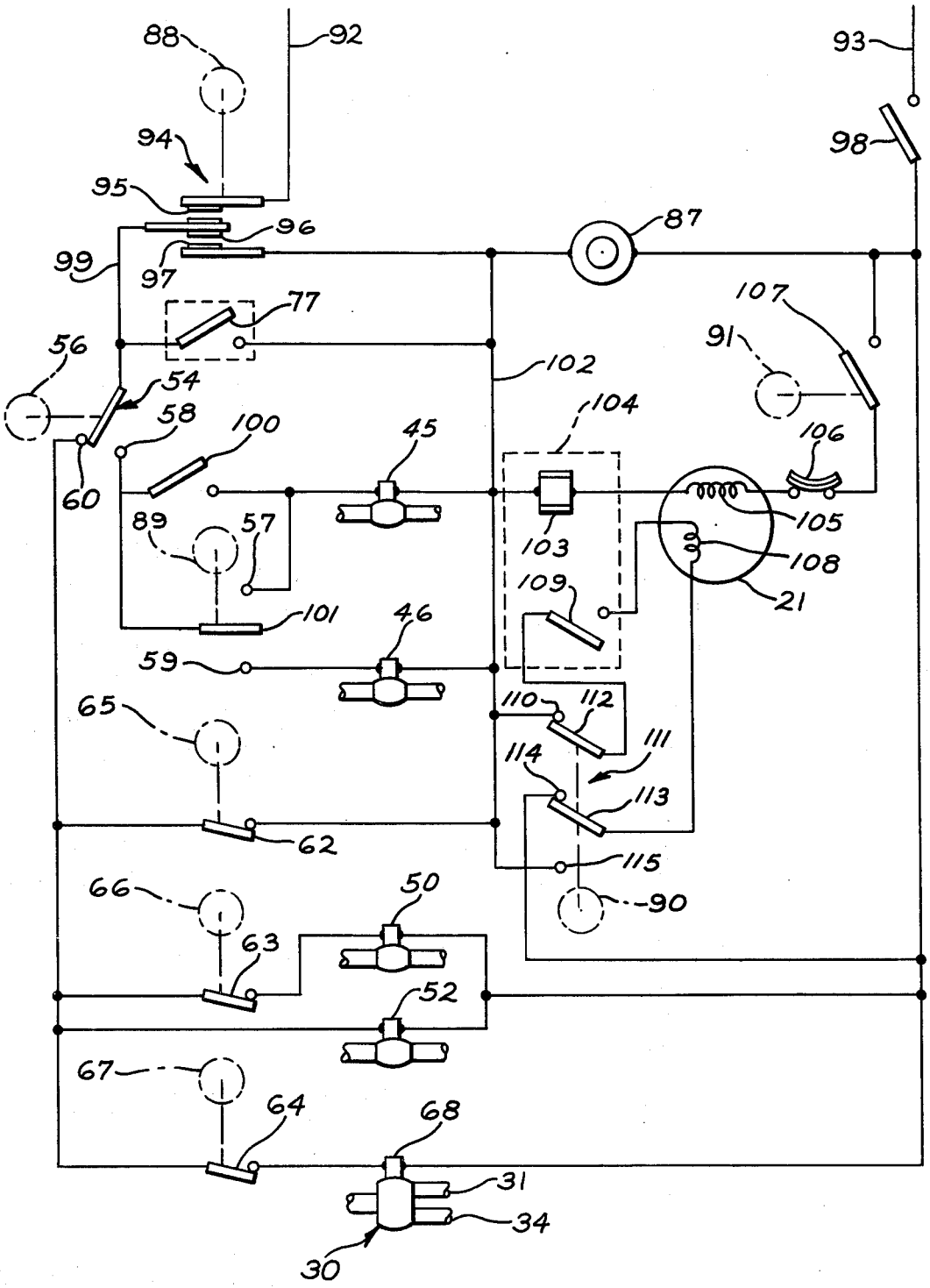
FIG. 2 is a schematic diagram of an electric control circuit that may be used with my invention in the machine in FIG. 1.

Completing now the description of the electrical control system for the machine of FIG. 1, reference is made to FIG. 2. At the heart of this control system is a sequence control assembly designated generally in FIG. 1 by the numeral 85 having a dial 86. Forming a part of the sequence control assembly 85 is a timer motor 87 which drives a plurality of cams 88, 89, 90 and 91. These cams, during their rotation by the timer motor, actuate various switches (as will be described), causing the machine to pass through the cycle of operations which includes washing, spinning, rinsing and spinning.

It will be understood that present day washers often include various improvements such as control panel lights, etc., which do not relate to the present invention and have been omitted for the sake of simplicity and ease of understanding.

The electric circuit, as shown in FIG. 2, as a whole is energized from a power supply (not shown), through a pair of conductors 92 and 93. Cam 88 controls a switch 94 which includes contacts 95, 96 and 97; when the cam has assumed the position where all three contacts are separated, washer 10 is disconnected from the power source and is inoperative. When operation of washer 10 is to be initiated for a "normal" operation, that is, when clothes are to be washed in basket 13 and basket 18 has been removed from the machine, switch 94 is controlled by cam 88 so that contacts 95 and 96 are engaged. Switch arm 54 is controlled by cam 56 and would take a position against contact 58. When a main switch 98 is closed (by any suitable manual control, not shown), power is then provided to the control circuit of the machine from conductor 92 through contacts 95 and 96. From contact 96, the circuit extends through a conductor 99, switch arm 54, contact 58, and a manually operated switch 100 to the valve solenoid 45. In addition, a circuit is completed from conductor 99 through a switch 101 controlled by cam 89. During the "normal" operation of the washer, cam 89 would cause switch 101 to close and make electrical connection with contact 59. In the "up" position, switch 101 completes a circuit through contact 57 for solenoid 45 independently of switch 100; in the "down" position shown, the switch 101 through contact 59 completes a circuit for solenoid 46. Thus, when switch 100 is open, energization of solenoids 45 and 46 is under the control of switch 101, but when switch 100 is closed the cold water solenoid 45 may be energized independently of the position of switch 101. From the hot and cold water solenoids, the energizing circuit then extends through a conductor 102 and then to a coil 103 of a relay 104, the main or run winding 105 of motor 21, a conventional motor protector 106, a switch 107 controlled by cam 91, and the conductor 93.

Motor 21 is of the conventional induction type which is provided with a start winding 108 which assists the main winding 105 during starting of the motor and is energized in parallel therewith. When a relatively high current passes through the relay coil 103, it causes the normally open switch 109 to close; this permits an energizing circuit for the start winding to be completed in parallel with the main winding through a contact 110 of the switch generally indicated at 111 and which is controlled by cam 90, contact arm 112, the relay contact 109, the start winding 108, a contact arm 113, and the contact 114 of switch 111. A circuit is also completed in parallel with motor 21 through the timer motor 87. Relay 104 is designed to close switch 109 when a relatively high current, of the level demanded by the motor when the motor is rotating below a predetermined speed, is passing through it. At other times when there is no current passing through the relay coil 103, or when the current is below the required energizing level as is true in the running speed range of the motor, the switch 109 is open.

When the main winding 105 of motor 21 is in series with valve solenoids 45 and 46, as described, a much lower impedance is presented in the circuit by the motor 21 than is presented by the valve solenoids. As a result, the greater portion of the supply voltage is taken up across the solenoids and relatively little across the motor. This causes whichever of the solenoids is connected in the circuit to be energized sufficiently to open its associated water valve. As a result, water at a selected temperature is admitted to the machine through hose 47, motors 21 and 87 remaining inactive.

This action continues, with the circuitry thus arranged, so that water is admitted to basket 13 and tub 12. Because of the perforations in basket 13, the water rises in both basket 13 and tub 12 at the same rate. Water level control switch 77 is connected across conductors 99 and 102 as shown, so that when switch 77 closes, it excludes the solenoids 45 and 46 from the effective circuit by short circuiting them. As a result, the solenoids become de-energized and a high potential drop is provided across winding 105 of motor 21. This causes the relay 104 to close contact 109 to start the motor 21 while, at the same time, timing motor 87 starts so as to initiate the sequence of operations. It will be observed that the energization of the valve solenoids 45 and 46 on the one hand, and the energization of the drive motor 21 on the other hand are alternative in nature. In other words, when there is sufficient potential across the valve solenoids to energize them, the motor remains de-energized, and it is necessary to short the solenoids out of the circuit so that they are de-energized before the drive motor can be energized.

The switch 107 is in series with the main motor 21 but is not in series with the timer motor 87. Thus, by the opening of switch 107, the energization of motor 21 may be stopped. The timer motor will continue to operate though, as a result of the fact that the timer motor 87 is deliberately provided with an impedance much greater than that of the valve solenoids so that it will take up most of the supplied voltage and the solenoids, therefore do not operate their respective valves.

A further point of the circuit of FIG. 2 is that when switch arms 112 and 113 are moved by cam 90 to engage contact 114 and a contact 115 respectively, the polarity of the start winding is reversed. The circuit from conductor 102 then proceeds through contact 115, contact arm 113 to start winding 108, relay contact 109, contact arm 112 and contact 114 to the switch 98 and conductor 93. Thus, provided motor 21 is stopped or slowed down so that relay contact 109 is closed, the reversal of switch 111 is effective to cause the motor 21 to rotate in the opposite direction when the motor is started up again.

In order to energize motor 21 independently of the water level switch 77 and the valve solenoid, so that a spin operation may be provided without regard to the absence of the predetermined water level, cam 88 is formed so that it may close all three contacts 95, 96, and 97 of switch 94 during the centrifugal liquid extraction operation. When this occurs, it causes the power to be supplied from conductor 92 directly through contact 97 to conductor 102 and the motor rather than through the water level switch or the valve solenoids.

Figure 3:
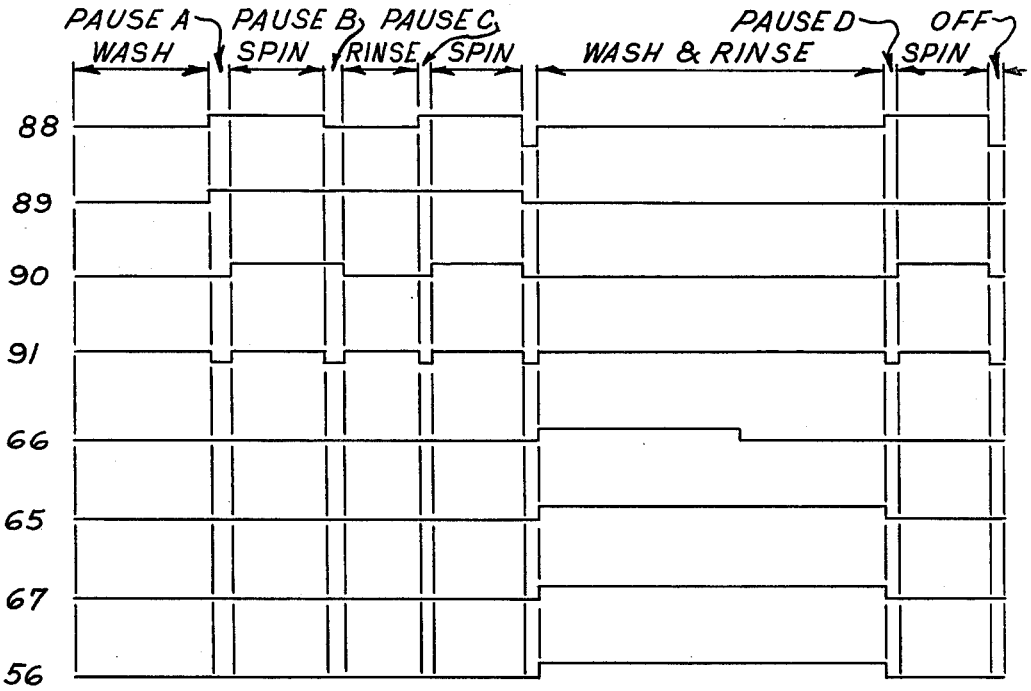
FIG. 3 is a schematic view of the cam surfaces used in the control of the timer operated switches of FIG. 2.

Referring now to FIG. 3 in conjunction with FIGS. 1 and 2, a sequence of operations of the washer 10 will be described during "normal" operation wherein clothes are washed in basket 13 and basket 18 has been removed from the machine. It will be assumed that the timer has been set at the beginning of the wash step so that cam 88 has caused contacts 95 and 96 to be closed, cam 56 caused contact arm 54 to connect with contact 58, cam 89 has caused contact 101 to move to its "down" position and connect with contact 59, cam 90 has positioned 111 as shown, and cam 91 has closed switch 107. At this point, with main switch 98 closed, the first step which takes place, because of the aforementioned impedance relationship, is the filling of the machine with water by the energization either of the solenoid 46 alone to provide hot water or else, if switch 100 has been manually closed, by the energization of solenoids 45 and 46 together to cause warm water to be supplied to the machine. The energization of the solenoids 45 and 46 causes motors 21 and 87 to remain inactive until the closure of switch 77 at a predetermined liquid level.

At this point, the solenoids 45 and 46 are de-energized and, consequently, motors 21 and 87 are energized. The energization of motor 21 is in the direction to cause agitator operation (because of switch 111) and to provide a recirculation action by pump 28, drawing water from the tub through inlet conduit 33 and then discharging it back into the tub through outlet conduit 34. This action, which conventionally is called the washing operation or wash mode, continues for a predetermined time until pause A is reached, at which time cam 91 opens switch 107. This stops the operation of motor 21 and, consequently, there is no further agitation although, as explained, the timer motor 87 continues to operate. During pause A, cam 88 closes all three contacts 95, 96 and 97 of switch 94 together to connect conductor 102 entirely independently of water level switch 77 and so as to exclude the valve solenoids 45 and 46. Also at this time cam 90 reverses the position of switch 111. The reversal of switch 111 reverses the polarity of start winding 108 relative to main winding 105. As a result, when switch 107 is re-closed by cam 91, motor 21 is energized once again but in the opposite direction. This is the end of pause A. The motor 21 is then driving the pump 29. The energization of the motor 21 and the de-energization of the valve solenoids result from the fact that the valve solenoids are bypassed by the new condition of switch 94. As a result of the opposite rotation of motor 21 from that of the wash mode, the motor causes a spin operation and simultaneously operates the pump 29. The pump 28 is ineffective during this operation, tending to draw in fluid through conduit 34 and expel it through conduit 33.

The spin operation is provided at a relatively high speed of rotation of the basket which may, for instance, be on the order of 600 RPM so as to extract a very substantial part of the liquid from the clothes and have it removed by the pump 29. The spin operation continues until pause B, as shown in FIG. 3, at which time switch 107 is again opened by cam 91 to de-energize motor 21. At this time, cam 88 returns switch 94 to the same position that it had for wash. In addition, it is conventional at this time to change the position of switch 101 to its "up" position so that the cold water solenoid is energized. Switch 94 also returns to the same position that it had for wash, with the contact 97 disengaged from the other two contacts, and the motor connections are reversed to provide agitation rather than spin action. Thus, when pause B is terminated by the reclosing of the switch 107 to cam 91, water enters the basket until the switch 77 is tripped, and then an agitation step proceeds in the same manner as the wash step, that is, by the shorting out of the valve solenoid by switch 77.

After a suitable rinsing period, another pause, designated C, is provided and also has a drain period followed by another spin operation performed in the same manner as before, after which cam 88 opens all three contacts of switch 94 to terminate the operation completely by de-energizing all components of the system.

It should be noted that while the use of a relay 104 is shown and described in the preferred embodiment above, a motor having a centrifugal switch for controlling the start winding may be used in place of the relay 104 and accomplish the same desirable function. Therefore, the function of relay 104 and the function of a centrifugal switch that controls the start winding of the motor are equivalent in operative effect.

The foregoing description of the clothes washing machine operation is the "normal" operation where clothes are washed in the basket 13 by oscillating the agitator back and forth while the wash water is recirculated to the basket 13. This is the prior art machine operation. By my invention I incorporate into that type of machine a separate combined continuous clothes washing and rinsing cycle. It may be selected by the machine operator by programming the controls as by selecting a portion of the dial 86 that automatically programs the cycle. This separate continuous washing and rinsing cycle is used to wash and rinse garments usually made of synthetic fibers, or blends of synthetic and cotton fibers, and the garments are washed and rinsed only in the small basket 18 with a fresh water flow-through system and not a bath type washing and rinsing action where the garments are submerged in the water. That is, the water used in the washing and rinsing operation does not fill the basket but rather is only enough to saturate the garments so that they are sopping wet and it also is not recirculated back into the basket but is pumped to an external drain. The fresh water introduced into the basket 18 is at a substantially reduced flow rate relative to the "normal" wash operation, and the wash and rinse operations are continuous with no centrifugal extraction operation until after the continuous wash and rinse operation. The wash and rinse water is flowed through the second basket 18 into the first basket 13 at a rate sufficient to prevent a bath type washing action in the second basket. The rate of water flow through the second basket 18 after the clothes become saturated would be at least equal to the rate of fresh water being introduced into the second basket 18. During the continuous wash and rinse operation, preferably, the temperature of the water in the basket 18 and therefore the garments, is gradually reduced. It has been found that by gradually reducing the temperature of clothes made of synthetic fibers their tendency to wrinkle is reduced. This is accomplished by stopping the flow of hot water part way through the continuous wash and rinse operation while either continuing the flow of cold water or starting the flow of cold water. The latter would be the case where the cycle was programmed to initially introduce only hot water as opposed to warm water where both hot and cold water is mixed to give a warm water wash. When the wash and rinse operation is completed agitation and water flow is stopped and a spin centrifugal extraction operation completes the cycle. At the time of spin the temperature of the clothes has been reduced so the tendency of them to wrinkle during spin is reduced.

With reference to FIG. 2, the electric circuit of the improved clothes washer and method of washing clothes will be described. FIG. 2 is shown in condition for the washer to implement the small load cycle that is incorporated into a conventional clothes washer. On this setting cam 88 closes switch 94 so the contacts 95 and 96 are engaged. Cam 56 causes switch 54 to be closed and connect with contact 60. Main switch 98 is closed (by any suitable manual control, not shown), so that power is then provided to the control circuit of the machine from conductor 92 through contacts 95 and 96 to contact 60.

From contact 60, the circuit extends through a conductor 61 to switches 62, 63, and 64, all of which are closed by respective cams 65, 66, and 67. Closing switch 62 causes the agitator 14 carrying the small basket 18 to oscillate back and forth as described heretofore in connection with operation of the machine utilizing "normal" wash and rinse operations. Switch 63 causes valve solenoid 50 to be energized and open its associated water valve, which in this case is the hot water. Solenoid 52 is also energized and causes its associated cold water valve to open resulting in both the hot and cold water flowing through the mixing valve 48 and exiting nozzle 47 into the small basket 18. With switch 64 closed by cam 67 a solenoid 68 is energized causing diverter 30 to divert the water into conduit 31 where it is pumped to an external drain and not recirculated through conduit 34 as was the case in connection with operation of the clothes washer during the "normal" operation.

It is highly desirable to have the water valves arranged to provide a much lower flow of water into basket 18 than was the case in connection with the "normal" clothes load operation of the machine through the mixing valve 44. Generally speaking, the "normal" operation of the machine requires about four gallons per minute for each of the hot and cold valves. In the case of the small wash load cycle, the water flow rate is between a quarter of a gallon and a gallon of water per minute total for both valves. The water is removed from the second basket 18 after the clothes become saturated at least at this rate by means of the openings being of sufficient number and size to prevent a bath type washing and rinsing action.

As can be seen particularly in FIG. 3, part way through the continuous wash and rinse operation, cam 56 opens switch 63 to de-energize solenoid 50 and close the hot water valve. The cold water valve will remain open through the rest of that cycle until reaching pause D. By this arrangement, the wash water temperature is gradually reduced from warm to cold before the clothes in the small basket 18 are subjected to a spin operation, which could normally induce wrinkling.

After the continuous wash and rinse operation the spin operation is conducted in the same manner as in connection with the "normal" washing operation and cams 56, 66, 65, and 67 cause their respective associated switches to be opened while the basket 18 is spinning to effect centrifugal extraction of water from the now cooled garments contained in the small basket 18. During the spin operation the pump unit 29 is operating to expel liquid from the tub to an external drain. At the end of the spin cycle operation, cam 88 causes switch 94 to open and terminate operation of the machine.

The foregoing is a description of the preferred embodiment of the invention, and it is to be understood that variations may be made thereto without departing from the true spirit of the invention, as defined by the appended claims.

What is claimed is:

1. In a vertical axis clothes washing machine having wash, rinse, and spin extraction operations including a tub, an agitator, a first basket within the tub, a second basket, having a side wall with a plurality of openings particularly at the bottom thereof, disposed within the first basket and positioned on the agitator for movement therewith, water supply means for feeding hot and cold water into the machine, electrically powered drive means for operating the agitator to effect washing of the fabrics and for rotating the baskets to centrifugally extract water from the fabrics, communication means to allow water to flow from the baskets into the tub, recirculating means arranged to take water from the tub and recirculate it into the baskets during the wash and rinse operations, the improvement comprising:

(a) a separate cycle of a continuous wash and rinse operation followed by a spin extraction operation for washing clothes in only the second basket including;

(i) means to continuously introduce fresh water into the second basket during the continuous wash and rinse operation, (ii) means to continuously flow wash and rinse water from the second basket through the openings therein into the first basket so that said second basket does not fill to a level beyond that necessary to maintain the clothes therein in a sopping wet condition and then from the first basket into the tub, (iii) diverting means in the recirculation means to continuously direct water to drain from the tub during the combined wash and rinse operation, (b) means to oscillate back and forth the small basket with the agitator in unison therewith during the continuous wash and rinse operation, (c) means to reduce the temperature of the fresh water introduced into the second basket part way through the continuous wash and rinse operation to gradually reduce the temperature of the clothes, and (d) means to stop the flow of fresh water into the second basket prior to the spin extraction operation and take water from the tub and direct the water to drain.

2. The vertical axis clothes washing machine of claim 1 wherein the fresh water flow into the second basket during the continuous wash and rinse operation is both hot and cold and the means to reduce the temperature of the fresh water includes means to close the hot water valve of the second set of water control valves to stop the flow of hot water part way through the continuous wash and rinse operation and continue the flow of cold water to gradually reduce the temperature of the clothes.

3. The vertical axis clothes washing machine of claim 1 wherein the fresh water flow into the second basket during the continuous wash and rinse operation is hot water only and the means to reduce the temperature of the fresh water includes means to close the hot water valve of the second set of water control valves to stop the flow of hot water and start the flow of cold water part way through the continuous wash and rinse operation to gradually reduce the temperature of the clothes.

4. The vertical axis clothes washing machine of claim 1 wherein means are included to provide fresh water flow into the second basket during the continuous wash and rinse operation at the rate of 0.25 to 1 gallon per minute.

5. In a vertical axis clothes washing machine having a wash fill, wash, spin extraction, rinse fill, rinse, and spin extraction operations including a tub, an agitator, a first basket within the tub, a set of water control valves for feeding hot and cold water into the machine at a first flow rate, electrically powered drive means for operating the agitator to effect washing of the fabrics and for rotating the basket and agitator in unison to centrifugally extract water from the fabrics, communication means to allow water to flow from the basket into the tub, recirculating means arranged to take water from the tub and recirculate it into the basket during the wash and rinse operations, the improvement comprising:

(a) a second basket, having a side wall with a plurality of openings particularly at the bottom thereof, disposed within the first basket and positioned on the agitator for movement therewith;

(b) a separate machine cycle of a continuous flow through combined wash and rinse operation followed by a spin extraction operation for washing clothes in only the second basket, said continuous flow through combined wash and rinse operation including;

(i) means including a second set of water control valves for hot and cold water to continuously introduce fresh water into the second basket during the continuous wash and rinse operation at a second flow rate less than the first flow rate, (ii) means to continuously flow wash and rinse water from the second basket through the openings therein into the first basket at a rate sufficient to prevent a bath type wash and rinse action in the second basket, and from the first basket into the tub, (iii) diverting means in the recirculation means to continuously direct water to drain from the tub during the combined wash and rinse operation, (iv) means to oscillate back and forth the second basket with the agitator in unison therewith during the continuous wash and rinse operation, (v) means to reduce the temperature of the fresh water introduced into the second basket part way through the continuous wash and rinse operation to gradually reduce the temperature of the clothes, and (vi) means to stop the flow of fresh water into the second basket prior to the spin extraction operation and take water from the tub and direct the water to drain.

6. The vertical axis clothes washing machine of claim 5 wherein the fresh water flow into the second basket during the continuous wash and rinse operation is both hot and cold and the means to reduce the temperature of the fresh water includes means to close the hot water valve of the second set of water control valves to stop the flow of hot water part way through the continuous wash and rinse operation and continue the flow of cold water to gradually reduce the temperature of the clothes.

7. The vertical axis clothes washing machine of claim 5 wherein the fresh water flow into the second basket during the continuous wash and rinse operation is hot water only and the means to reduce the temperature of the fresh water includes means to close the hot water valve of the second set of water control valves to stop the flow of hot water and start the flow of cold water part way through the continuous wash and rinse operation to gradually reduce the temperature of the clothes.

8. The vertical axis clothes washing machine of claim 5 wherein means are included to provide fresh water flow into the second basket during the continuous wash and rinse operation at the rate of 0.25 to 1 gallon per minute.

* * * * *